US006476302B1

(12) United States Patent
Liu

(10) Patent No.: US 6,476,302 B1
(45) Date of Patent: Nov. 5, 2002

(54) SAXOPHONE

(76) Inventor: Jung-Jung Liu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/854,895

(22) Filed: May 11, 2001

(51) Int. Cl.[7] ..... G10D 7/08
(52) U.S. Cl. ..... 84/385 R; 84/386
(58) Field of Search ..... 84/385 R, 386

(56) References Cited

U.S. PATENT DOCUMENTS 2,846,917 A * 8/1958 Lefevre-Selmer ..... 84/385 R
4,353,281 A * 10/1982 DeFord ..... 84/384
4,516,463 A * 5/1985 Satoh ..... 84/385 R

* cited by examiner

*Primary Examiner*—Shih-Yung Hsieh

(57) ABSTRACT

A saxophone has a main body, a neck, a treble connection set, a connection rod, and a link set. The main body has a high G hole and a high F sharp hole. A high G button and a high G cover are connected by the connection rod. The neck has a treble hole. A treble cover is disposed on the neck. A helical tube is connected to the treble cover to surround the neck. A treble button is disposed on a lower end of the treble connection set. The treble button has a groove. A high F sharp button and a high F sharp cover are connected by the link set.

1 Claim, 7 Drawing Sheets

SAXOPHONE

BACKGROUND OF THE INVENTION

The present invention relates to a saxophone. More particularly, the present invention relates to a saxophone which has a high G button and a high G cover connected by a connection rod.

Referring to FIG. 1, a conventional saxophone 1 often has a very complex structure with many buttons. Therefore, a beginner will touch the wrong button easily while two buttons are very close to each other.

SUMMARY OF THE INVENTION

An object of the present invention is to provide a saxophone which has a high G button and a high G cover connected by a connection rod and the distance between the high G button and the high G cover is short so that a high G sound will be performed quickly and precisely.

Accordingly, a saxophone comprises a main body, a neck disposed on the main body, a treble connection set connected to the main body, a connection rod connected to the main body, and a link set connected to the main body. The main body has a high G hole and a high F sharp hole. A high G button and a high G cover are connected by the connection rod. The high G cover matches the high G hole of the main body. The neck has a treble hole. A treble cover is disposed on the neck to match the treble hole. A helical tube is connected to the treble cover to surround the neck. A treble button is disposed on a lower end of the treble connection set. The treble button has a groove. A high F sharp button and a high F sharp cover are connected by the link set. The high F sharp cover matches the high F sharp hole. The high G button is located over the treble button.

DETAILED DESCRIPTION OF THE INVENTION

Figure 1:
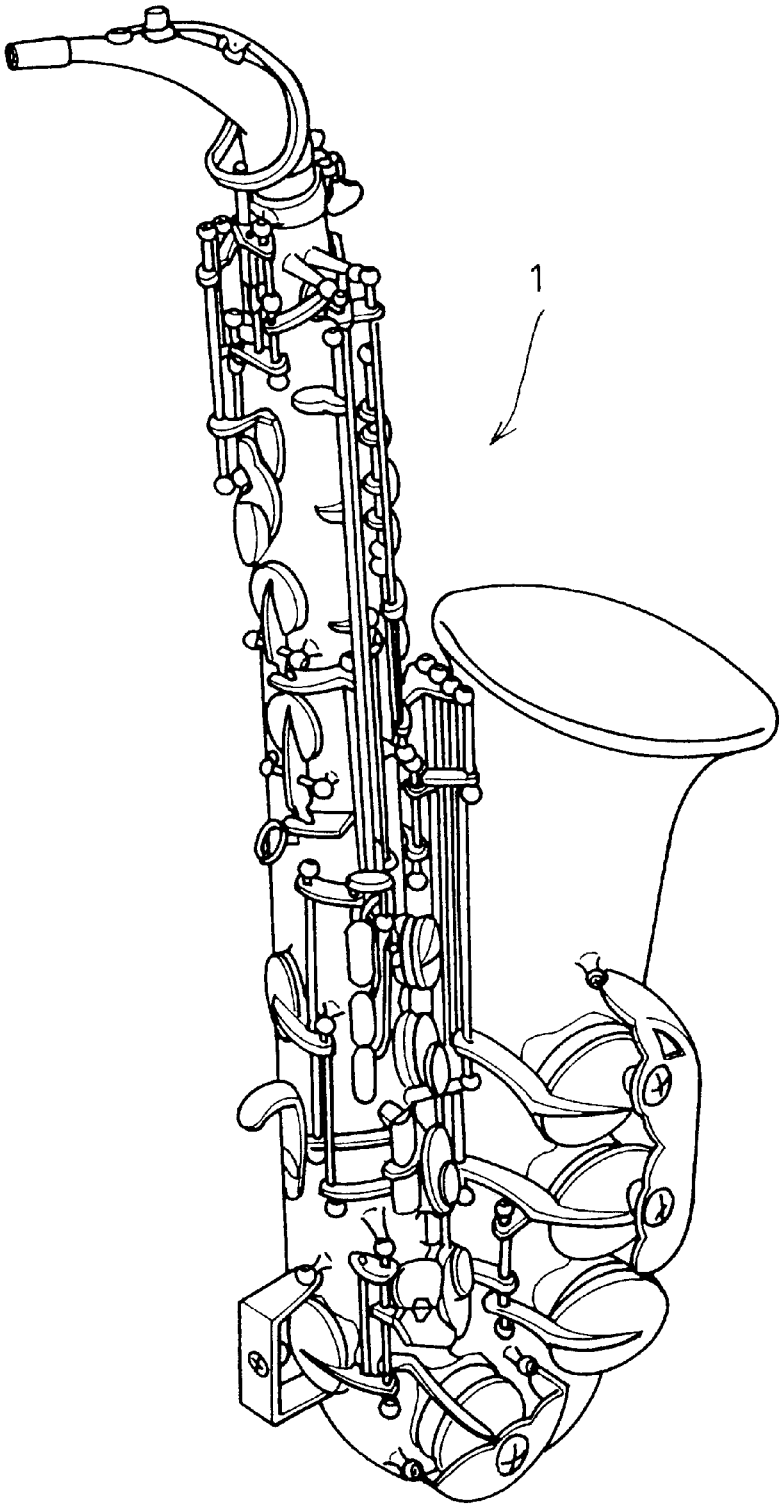
FIG. 1 PRIOR ART
FIG. 1 is a perspective view of a conventional saxophone of the prior art.
Figure 2:
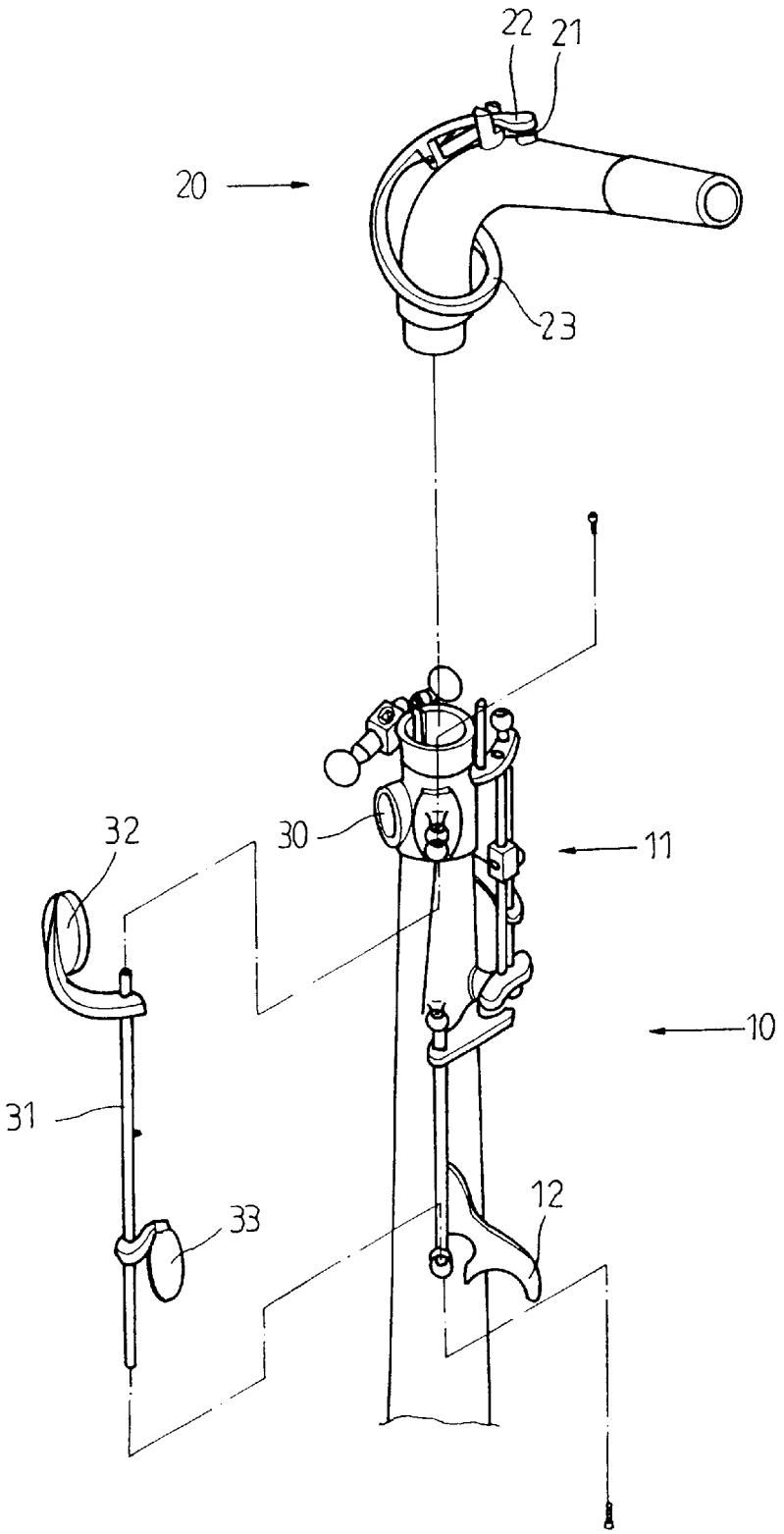
FIG. 2 is a perspective exploded view of a neck, a treble connection set, and a connection rod of a preferred embodiment in accordance with the present invention.
Figure 3:
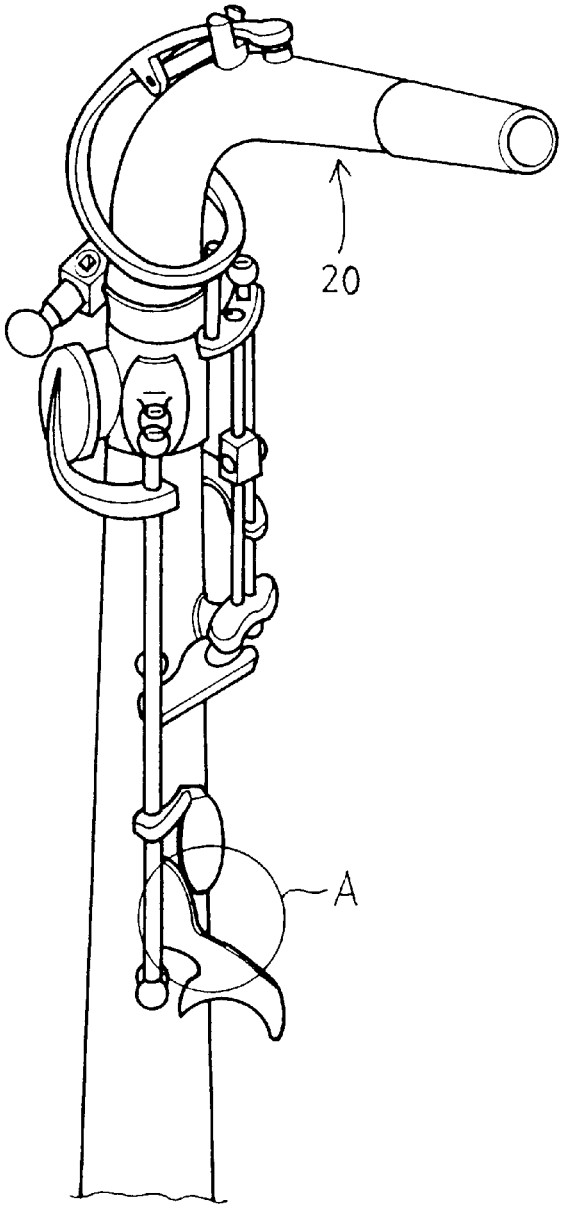
FIG. 3 is a partially perspective view of a saxophone of a preferred embodiment in accordance with the present invention.
Figure 3A:
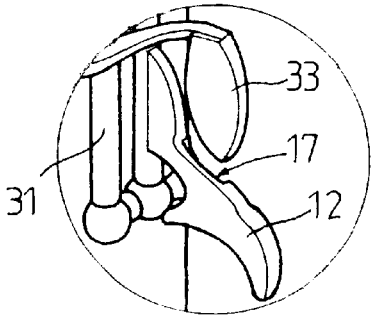
FIG. 3A is a partially perspective view of FIG. 3.
Figure 4:
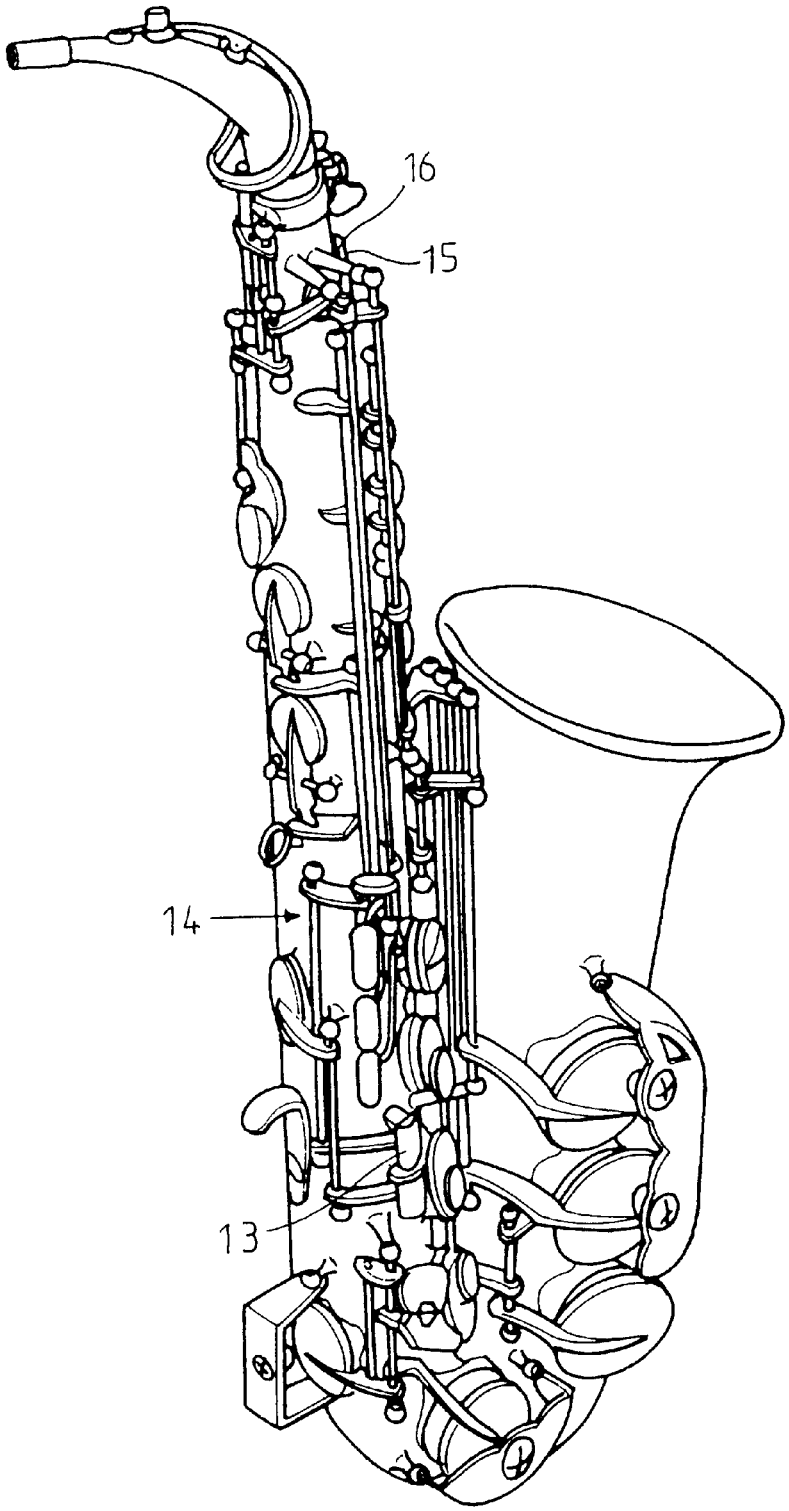
FIG. 4 is a perspective view of a saxophone of a preferred embodiment in accordance with the present invention.
Figure 5:
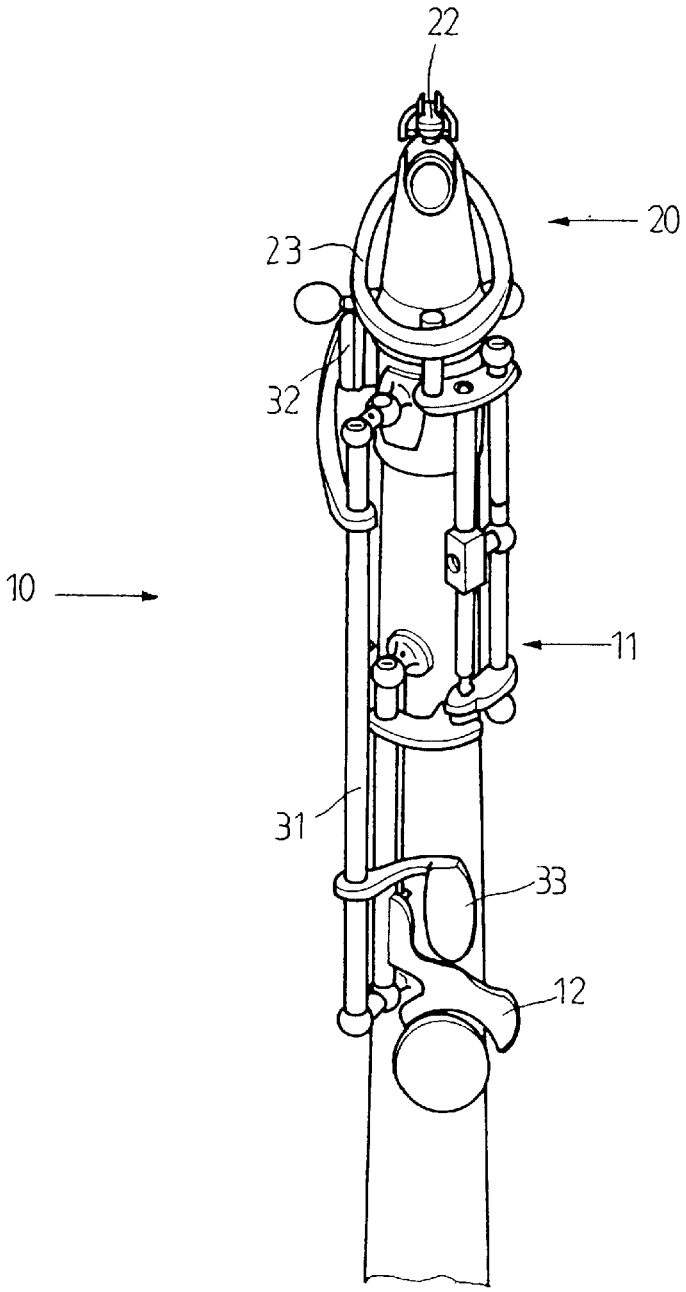
FIG. 5 is a schematic view illustrating a first operation of a saxophone of a preferred embodiment in accordance with the present invention.
Figure 5A:
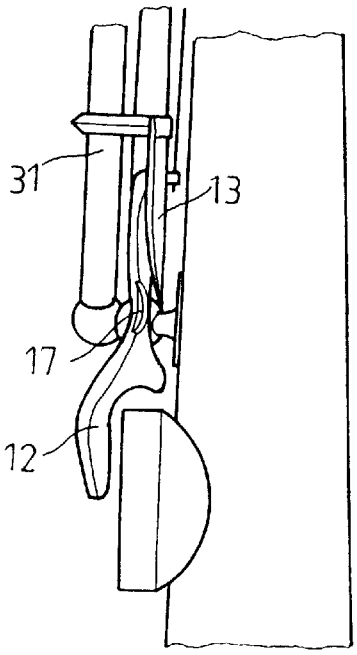
FIG. 5A is a partially elevational view of FIG. 5.
Figure 6:
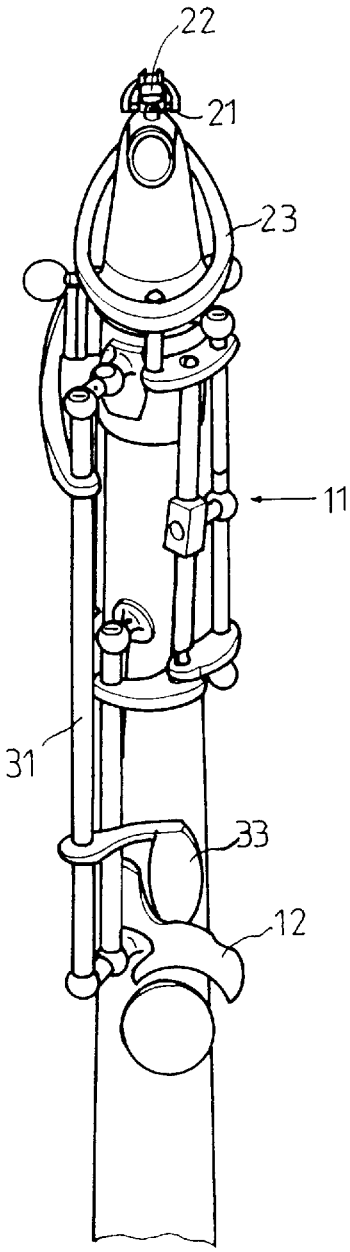
FIG. 6 is a schematic view illustrating a second operation of a saxophone of a preferred embodiment in accordance with the present invention.
Figure 6A:
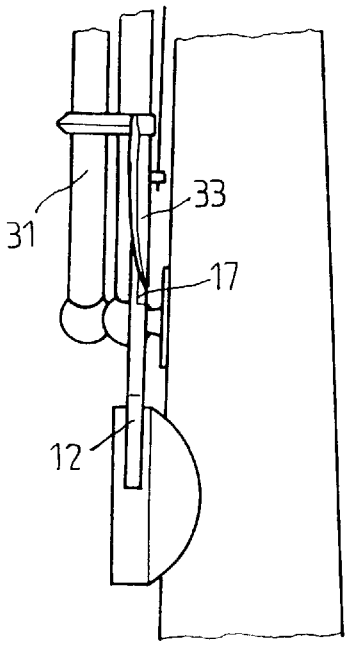
FIG. 6A is a partially elevational view of FIG. 6.
Figure 7:
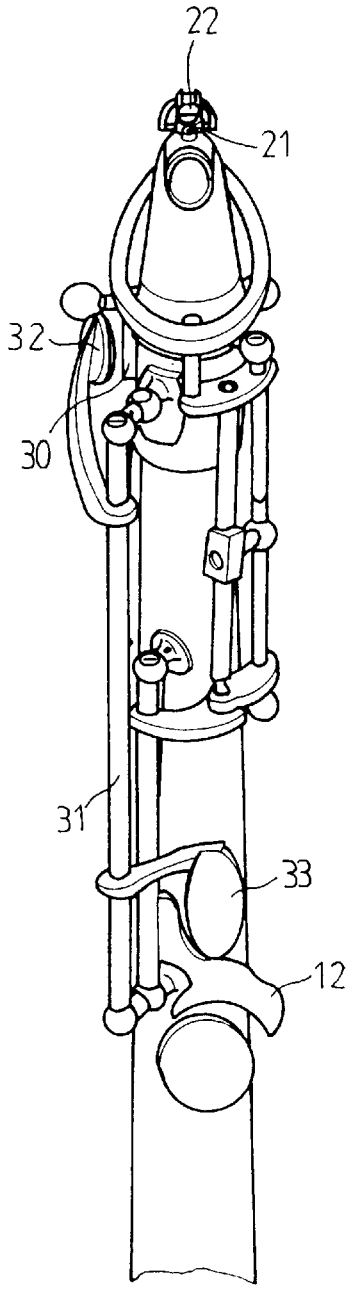
FIG. 7 is a schematic view illustrating a third operation of a saxophone of a preferred embodiment in accordance with the present invention.
Figure 7A:
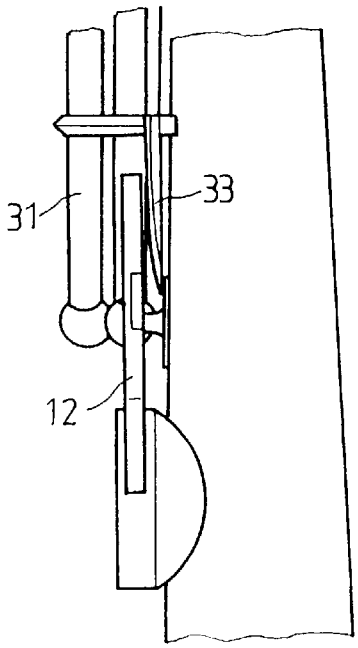
FIG. 7A is a partially elevational view of FIG. 7.

Referring to FIGS. 2 to 4, a saxophone comprises a main body 10, a neck 20 disposed on the main body 10, a treble connection set 11 connected to the main body 10, a connection rod 31 connected to the main body 10, and a link set 14 connected to the main body 10.

The main body 10 has a high G hole 30 and a high F sharp hole 16.

A high G button 33 and a high G cover 32 are connected by the connection rod 31.

The high G cover 32 matches the high G hole 30 of the main body 10.

The neck 20 has a treble hole 21.

A treble cover 22 is disposed on the neck 20 to match the treble hole 21.

A helical tube 23 is connected to the treble cover 22 to surround the neck 20.

A treble button 12 is disposed on a lower end of the treble connection set 11.

The treble button 12 has a groove 17.

A high F sharp button 13 and a high F sharp cover 15 are connected by the link set 14.

The high F sharp cover 15 matches the high F sharp hole 16.

The high G button 33 is located over the treble button 12. Since the groove 17 is formed on the treble button 12, a saxophonist will not touch the high G button 33 while pressing the treble button 12.

Referring to FIGS. 5 to 7A, a finger (not shown in the figures) of the saxophonist presses the treble button 12 and the finger slides upward to press the high G button 33.

Since the distance between the high G button 33 and the high G cover 32 is short, a high G sound will be performed quickly and precisely.

The invention is not limited to the above embodiment but various modification thereof may be made. Further, various changes in form and detail may be made without departing from the scope of the invention.

I claim:

1. A saxophone comprises:

a main body, a neck disposed on the main body, a treble connection set connected to the main body, a connection rod connected to the main body, a link set connected to the main body, the main body having a high G hole and a high F sharp hole, a high G button and a high G cover connected by the connection rod, the high G cover matching the high G hole of the main body, the neck having a treble hole, a treble cover disposed on the neck to match the treble hole, a helical tube connected to the treble cover to surround the neck, a treble button disposed on a lower end of the treble connection get, the treble button having a groove, a high F sharp button and a high F sharp cover connected by the link set, the high F sharp cover matching the high F sharp hole, and the high G button located over the treble button.

* * * * *